US007658567B2

(12) United States Patent
Sheu

(10) Patent No.: US 7,658,567 B2
(45) Date of Patent: Feb. 9, 2010

(54) AUTOMATIC PENCIL

(76) Inventor: Rong-Lin Sheu, 16, Sanjin Bieshu, Guomin Rd., Wu Jieh Hsiang, Yilan Hsien (TW)

( * ) Notice: Subject to any disclaimer, the term of this patent is extended or adjusted under 35 U.S.C. 154(b) by 11 days.

(21) Appl. No.: 12/102,031

(22) Filed: Apr. 14, 2008

(65) Prior Publication Data

US 2009/0257813 A1 Oct. 15, 2009

(51) Int. Cl.
*B43K 21/22* (2006.01)

(52) U.S. Cl. ..... 401/93

(58) Field of Classification Search ..... 401/92–94
See application file for complete search history.

(56) References Cited

U.S. PATENT DOCUMENTS 6,854,909 B2 * 2/2005 Fukumoto et al. ..... 401/92
7,452,147 B2 * 11/2008 Rolion et al. ..... 401/65

* cited by examiner

*Primary Examiner*—Huyen Le
(74) *Attorney, Agent, or Firm*—Leong C. Lei

(57) ABSTRACT

Au automatic pencil comprising an outer pencil tube, a pencil head, a clipping device, a guiding tube and a pencil lead cylinder, characterized in that a resilient element is mounted between the guiding tube and the clipping device allowing the guiding tube to reciprocate upward and downward within the stopper. The resilient element urges the guiding tube to rise upward if the pencil lead cylinder is not depressed, and to keep a distance from the pencil lead, and to allow another pencil lead to be inserted. The pencil lead cylinder can adapt a plurality of pencil lead.

2 Claims, 11 Drawing Sheets

AUTOMATIC PENCIL

BACKGROUND OF THE INVENTION (a) Technical Field of the Invention

The present invention relates to automatic pencil, and in particular, an automatic pencil allowing vertically depressing of a pencil lead to protruded from the tip of the automatic pencil.

(b) Description of the Prior Art

FIG. 1 is a conventional automatic pencil. The pencil has a hollow pencil shaft 1 having a bottom end linked to a pencil head 10. The center region of the pencil head 10 is being mounted with a pencil tip 11. The pencil head 10 is extended to mount a mounting cylinder 100 and is positioned with a pencil shaft. The pencil tip 11 is a banding ring 110 having frictional force to pull a pencil lead 12. A stopper is provided on the pencil tip 11 which is formed from two semi-circular stopping plates 13. The bottom end is extended until the slot within the top end of the pencil tip 11 and is mounted with a spring 14, allowing the pencil tip 11 to reciprocate upward and downward.

The bottom section of the stopping plates 13 is a slot 131 for the mounting of rolling ball 15, and is in combination with the inner wall of the inner cylinder 16. The top section of the inner cylinder 16 is mounted with a guiding tube 17 and the utmost end has a capping body 18. The top end of the capping body is an eraser 181.

Pencil leads 12 are inserted via the guiding tube 17. When the pencil leads 12 are depressed downwardly to the stopping plates 13, the depression of the pencil tip 11 when writing will automatically push out the pencil lead 12 without any other operation action, and can continuously in writing, which is very convenient in application. Conventional pencil leads are generally very long and when pencil leads are placed within the guiding tube 17, there is no any device to downward depress of the pencil leads, therefore the pencil shaft 1 has to be shaked so that the lead will side down to the stopping plate 13 and via the depressed pencil tip 11, the compression spring 14 causes the pencil tip 11 to inwardly contracted into the pencil shaft 1. When depression force is released, the spring 14 causes the tip 11 to protrude out from the pencil head 10 and at the same time, a pencil is withdraw at a great length. Repeating the action for several times, the pencil lead 12 is pushed out for utilization.

Whether or not there are pencil leads 12 contains in the pencil shaft 1, it can not be seen from outside of the pencil shaft 1, even the remaining of the lead cannot be determined. Thus, when the user opens the capping body 18 and inserts another pencil lead, the guiding hole 19 may be blocked and the pencil lead 12 is broken or is being blocked. In the conventional automatic pencil, no pencil lead cylinder is provided to the pencil shaft 1 and therefore, the pencil shaft 1 cannot hold extra pencil leads.

SUMMARY OF THE INVENTION

The primary purpose of the present invention is to provide an automatic pencil comprising an outer pencil tube, a pencil head, a clipping device, a guiding tube and a pencil lead cylinder, characterized in that a resilient element is mounted between the guiding tube and the clipping device allowing the guiding tube to reciprocate upward and downward within the stopper.

A further object of the present invention is to provide an automatic pencil, wherein the pencil lead cylinder has a sealing cap having an end face forming into a guiding arch surface.

Yet a further object of the present invention is to provide an automatic pencil, wherein the top end face of the guiding tube is formed into a guiding arch surface which is extended to a through hole formed at the center of the guiding tube.

Still a further object of the present invention is to provide an automatic pencil, wherein the guiding tube is provided with a hollow guiding shaft.

Yet still an object of the present invention is to provide an automatic pencil, wherein the bottom end of the guiding shaft is downwardly formed into a guiding hole.

An advantage of the present invention is that the resilient element 50 mounted between the guiding tube 6 and the clipping device 5 allows the insertion of a second pencil lead 40, and the pencil lead 40 will not be engaged at the arch surface 62.

Yet another advantage is that the pencil lead cylinder 4 can contain a plurality of pencil lead 40 and can be inserted to the pencil shaft 2.

Still another advantage is that the pencil lead cylinder can be replaced with a new one.

Further advantage of the present invention is that the lead is guided by the arch surface 421 and the pencil lead 40 is moved vertically downward without breaking.

Still a further advantage of the invention is that when the guiding rod 64 is depressed, the pencil lead can be guided to the pencil shaft 2 via the guiding hole 641 and smoothly passes through the through hole 63 of the guiding tube without engagement or breaking the pencil lead 40.

The foregoing object and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENTS

The following descriptions are of exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

Figure 1:
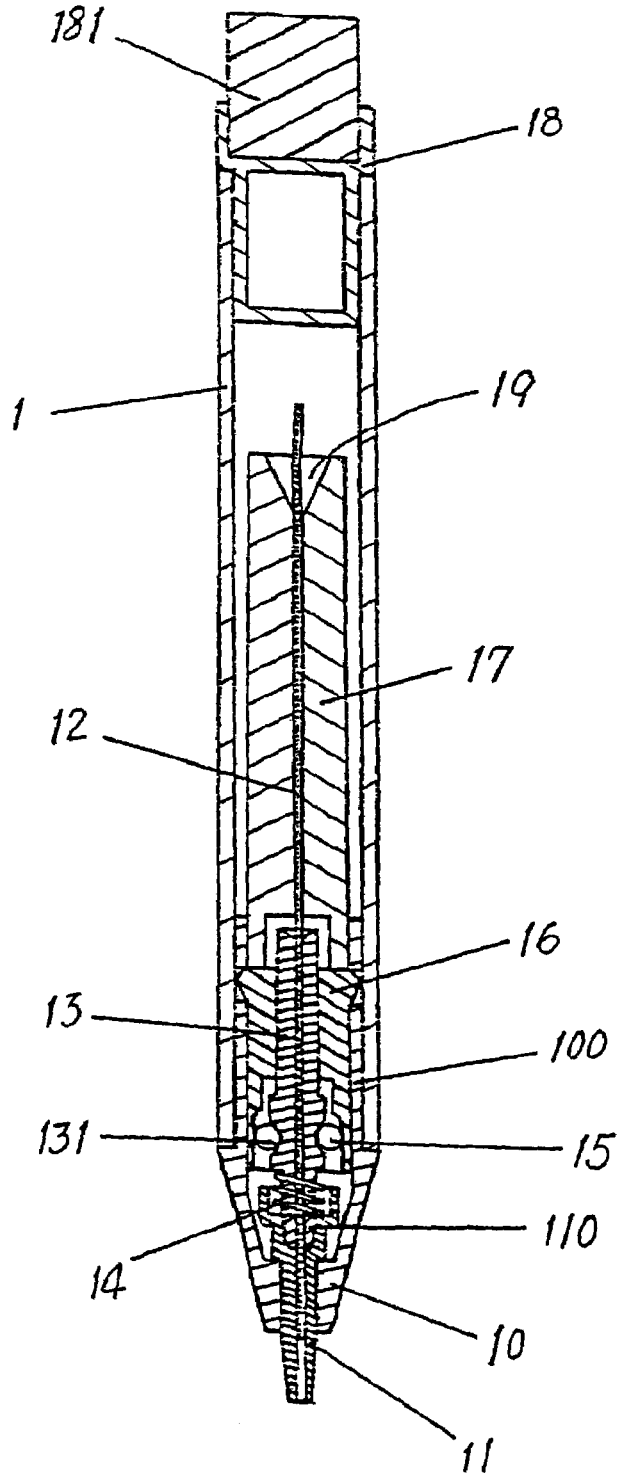
FIG .1 PRIOR ART
FIG. 1 is a sectional view of a conventional automatic pencil.
Figure 2:
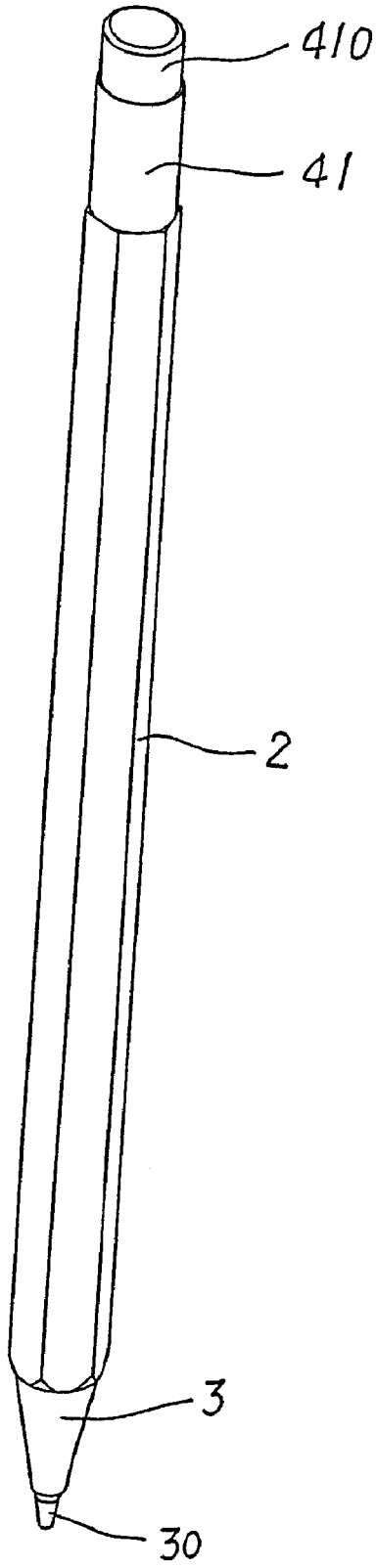
FIG. 2 is a perspective view of an automatic pencil in accordance with the present invention.
Figure 3:
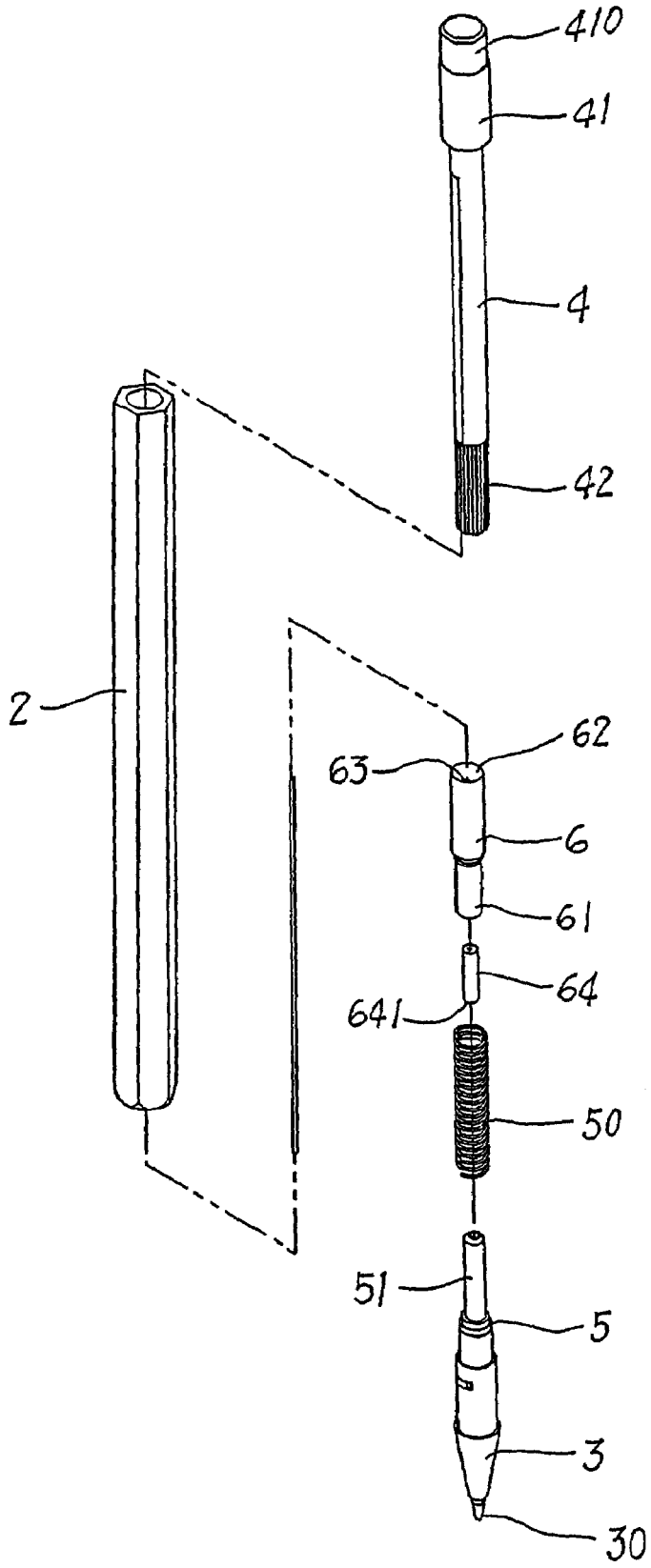
FIG. 3 is a perspective exploded view of an automatic pencil in accordance with the present invention.

The present invention will now be described in connection with FIG. 2. There is shown an automatic pencil comprising a pencil shaft 2, a pencil head 3, a pencil lead cylinder 4 and a clipping device 5 within the pencil shaft 2, and a guiding tube 6, and a resilient element 50 mounted thereto. The pencil head 3 is connected to the bottom end of the pencil shaft 2 such that the pencil tip 30 is protruded out of the pencil head 3, and the pencil lead cylinder 4 at the top end is inserted into the hollow interior of the pencil shaft 2. As regards to the structure of the guiding tube 6 and the clipping device 5 and the resilient element, FIG. 3 indicates this structure. The top end of the pencil head 3 is connected to the clipping device 5 and the resilient element 50 is mounted onto the clipping device 5 and is then mounted with the guiding tube 6 such that the resilient element 50 is connected between the mounting rod 61 of the guiding tube 6 and the combination rod 51 of the clipping device 5 which can press the resilient element 50 onto the combination rod 51 to cause an upward and downward movement, and the top end face of the guiding tube 6 is provided with a guiding arch face 62 and the center of the guiding tube 6 is a through hole 63 allowing the pencil lead 40 to pass through. A guiding rod 64 is positioned within the guiding tube 6 and formed with a guiding hole 641. Further, the pencil lead cylinder 4 matches the pencil shaft 2 which has a hollow interior. The upper or top end of the cylinder 4 is an end head 41 which has a top end for mounting an eraser 410. The bottom end of the cylinder 4 is a sealing cap 42 to cap the pencil leads for spare use.

Figure 4:
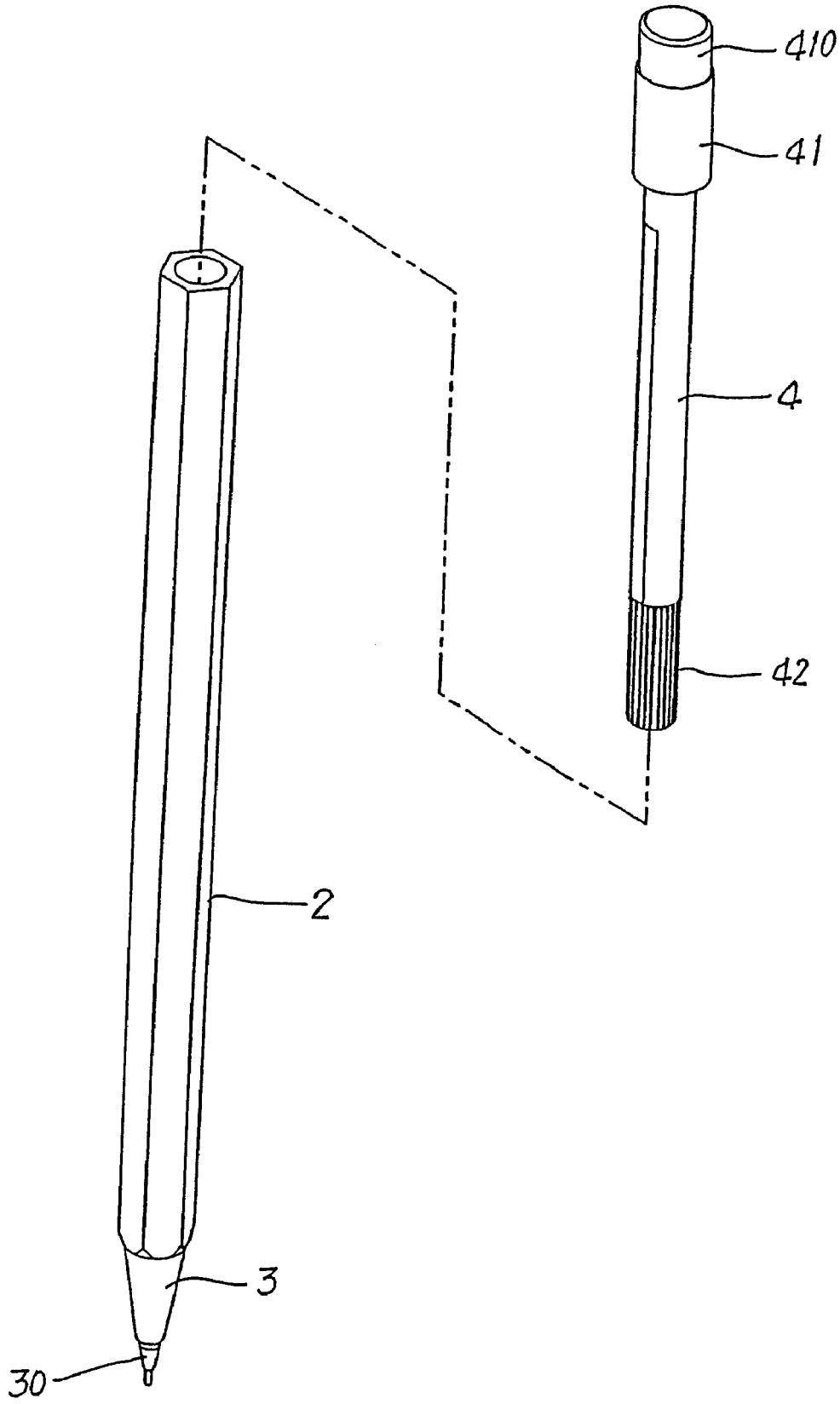
FIG. 4 is a perspective view of the pencil lead cylinder in accordance with the present invention.

As shown in FIG. 4, the resilient element 50 is connecting the clipping device 5 and the guiding tube 6 and the clipping device 5 is connected on the top end of the pencil head 3, and the combined structure is inserted to the bottom end of the pencil shaft 2. The pencil lead cylinder 4 is tubular having the top end being the end head 41 which can be engaged at the top end of the pencil shaft 2. The top end of the end head 41 is mounted with an eraser 410, and the bottom end of the pencil lead cylinder 4 is a sealing cap 42 which could vertically hold the pencil lead 40.

Figure 5:
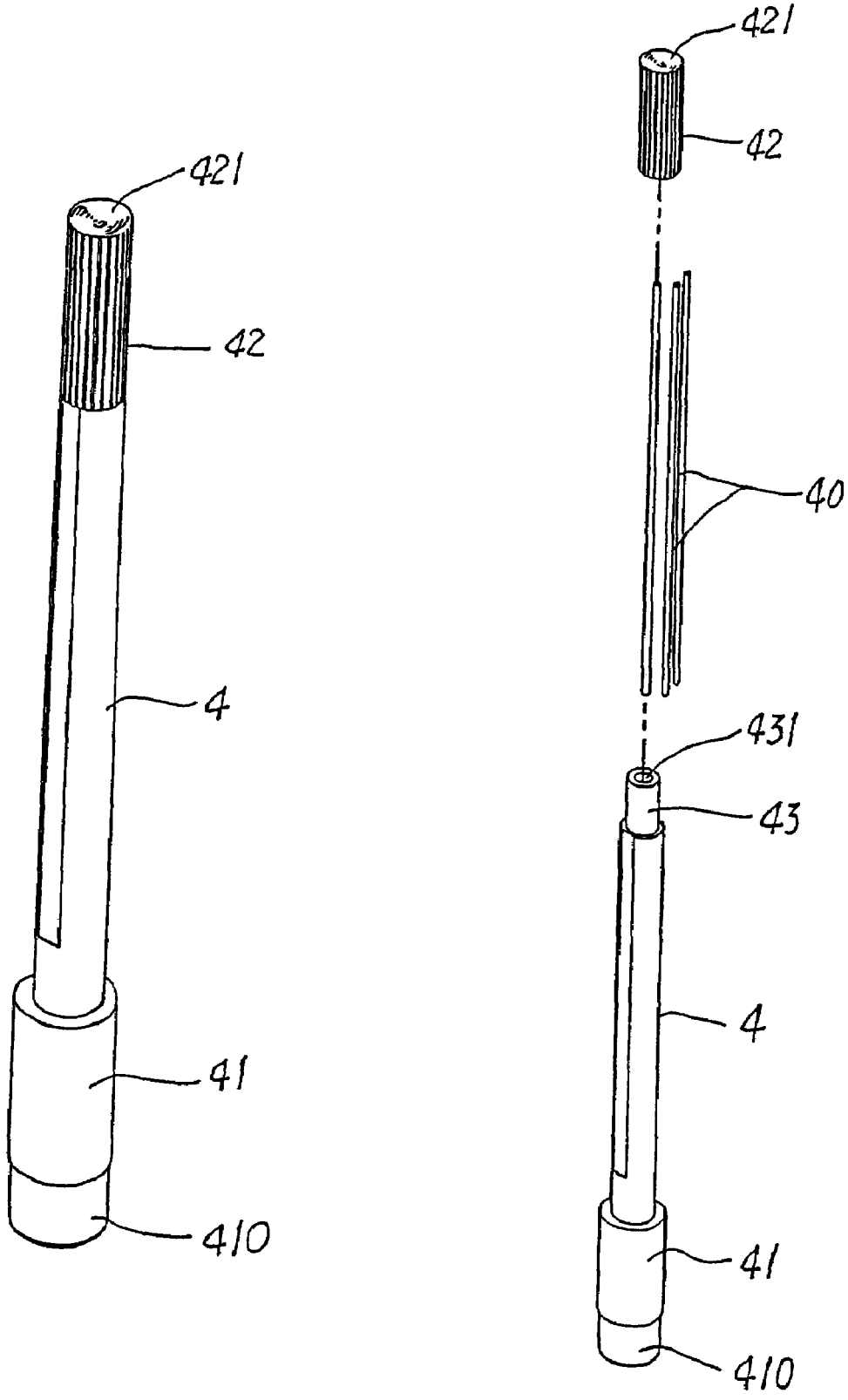
FIG. 5 is an exploded perspective view of the pencil leads cylinder in accordance with the present invention.
Figure 6:
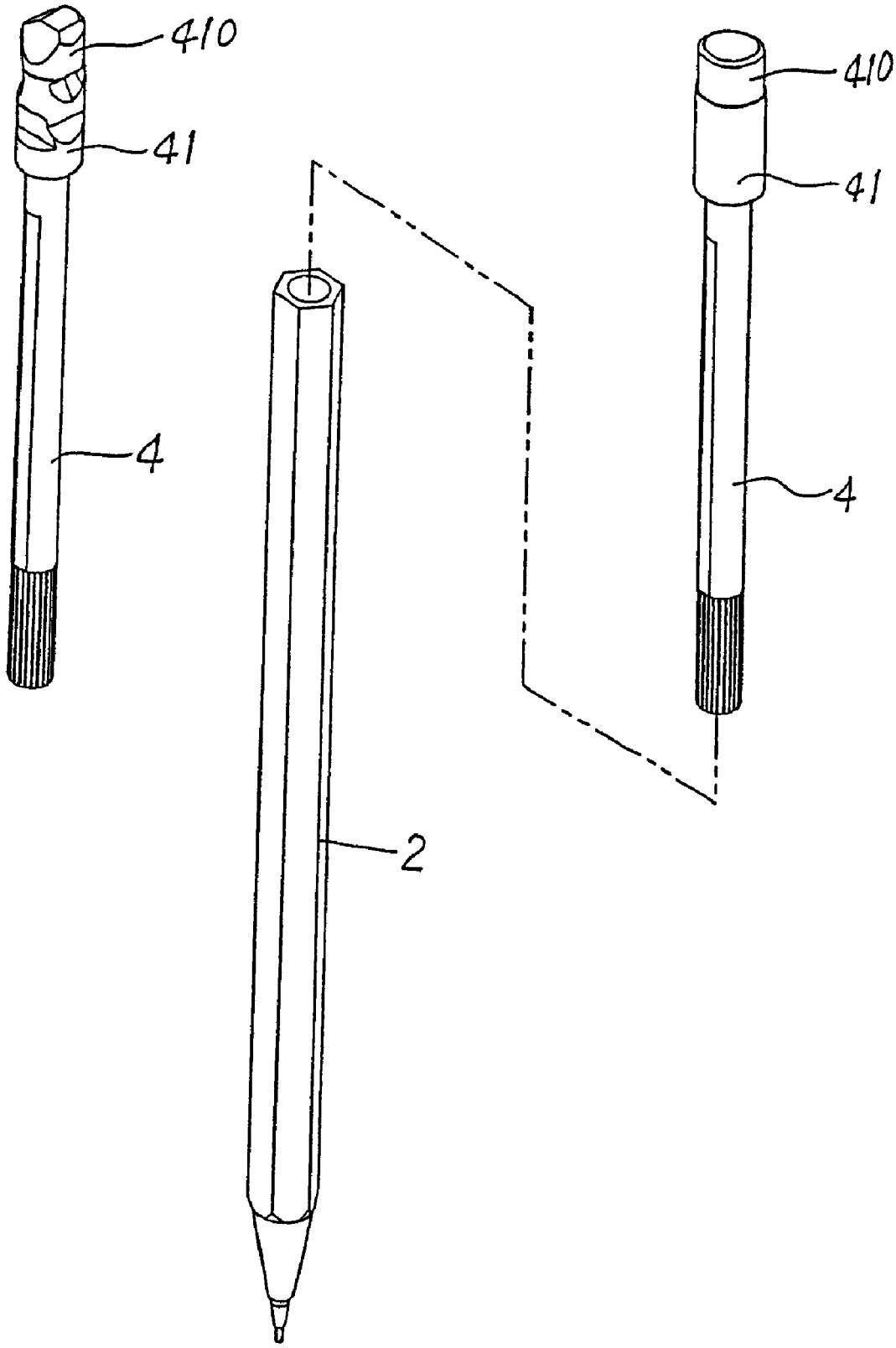
FIG. 6 is a perspective view showing the change of the pencil lead cylinder in accordance with the present invention.

As shown in FIG. 5, there is shown the structure of the pencil lead cylinder 4. The pencil lead cylinder 4 has an end head 41 which can hold an eraser 410. The sealing cap 42 can be uncapped, and the end side is a guiding arch surface 421. When the sealing cap 42 is withdrawn, the pencil lead 40 can be inserted via the through hole 431 of the mounting rod 43 and is then capped by the sealing cap 42, which can hold a plurality of spare pencil leads 40. When the pencil lead cylinder 4 is inserted into the top end of the pencil shaft 2 as shown in FIG. 6, the end head 41 or the eraser 410 may be damaged if it is bitten (by children). At this instance, only the pencil lead cylinder 4 is replaced.

Figure 7:
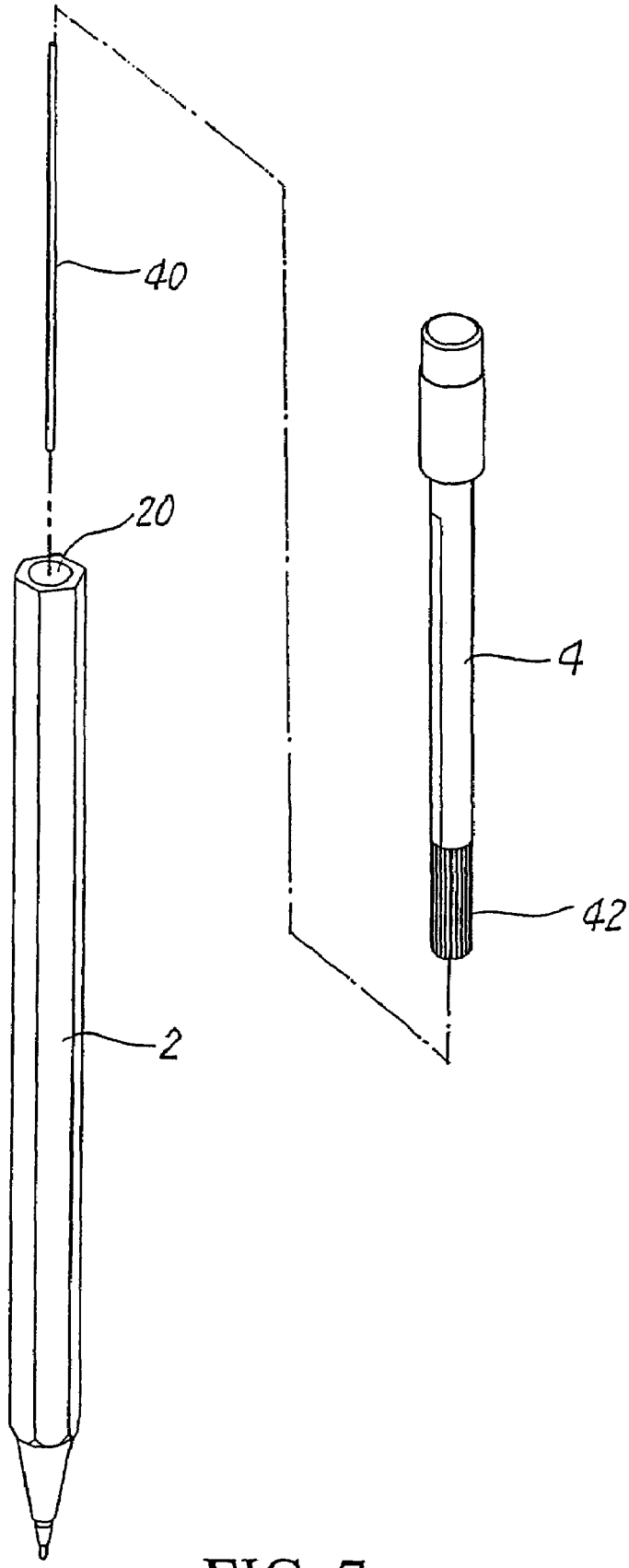
FIG. 7 is a perspective view showing the movement of the pencil lead within the pencil lead cylinder of the present invention.
Figure 8:
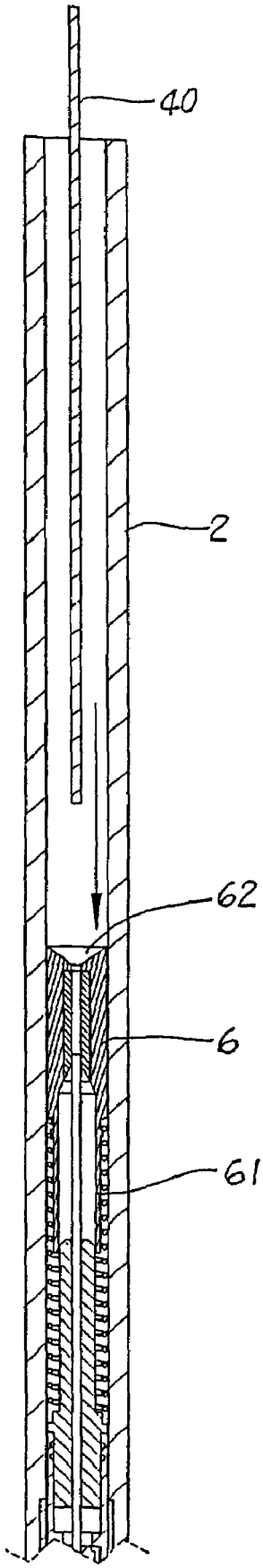
FIGS. 8 and 9 are sectional views indicating the pencil lead within the pencil lead cylinder of the present invention.
Figure 9:
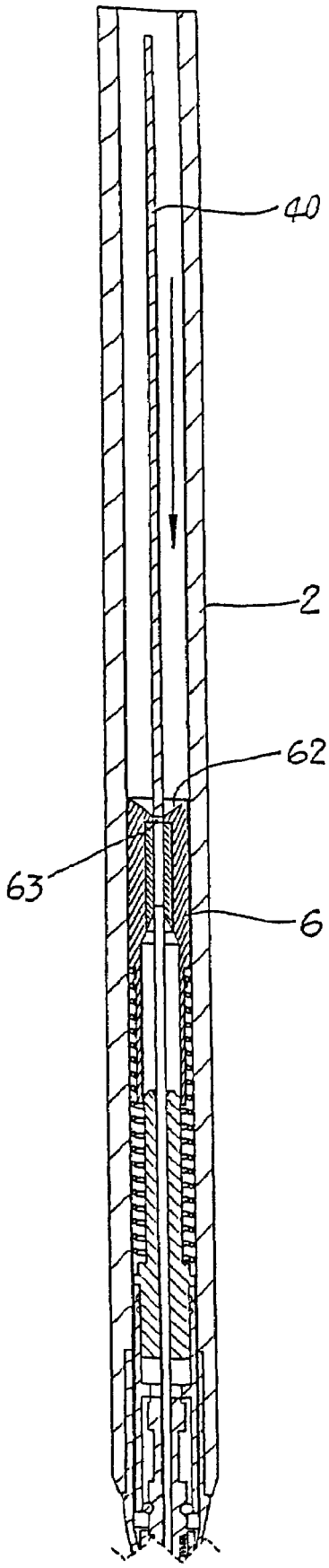

Referring to FIG. 7, when in use, the pencil lead cylinder 40 is pulled out, disengaged from the through hole 20 of the pencil shaft 2 and the pencil lead 40 is inserted through the through hole 20, and then the pencil lead cylinder 4 is inserted and the sealing cap 42 is capped to depress the pencil lead 40. Thus, the insertion of pencil lead 40 is complete.

Figure 10:
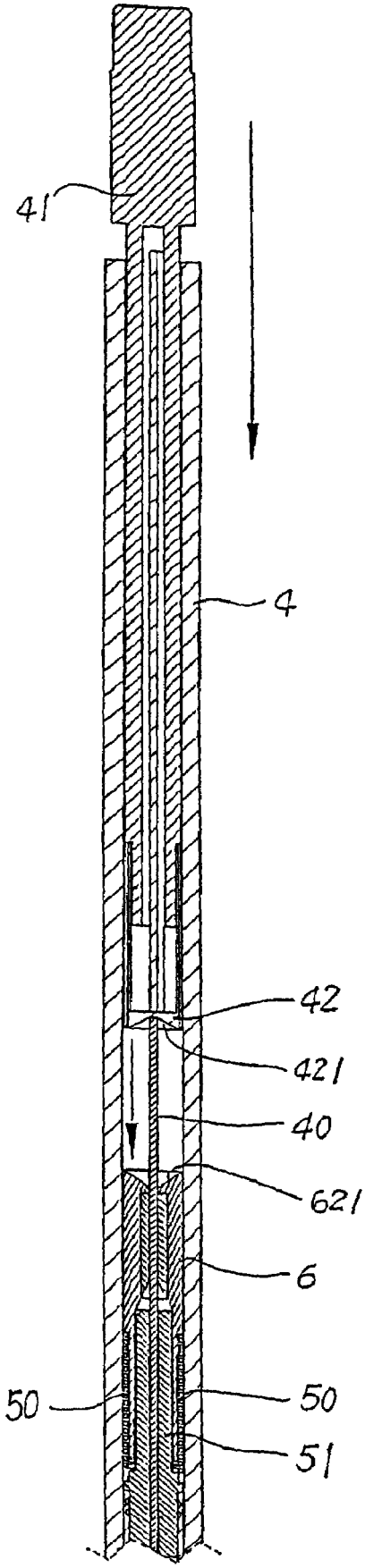
FIG. 10 is a sectional view showing the stopping of the pencil lead within the pencil lead cylinder of the present invention.

FIGS. 8-11 show the movement of the insertion of pencil lead 40 in accordance with the present invention. When the pencil lead 40 is inserted into the interior of the pencil shaft 2 (shown in FIG. 8), one end of the pencil lead 40 will directly contact the guiding arch surface 62 at the top end of the guiding tube 6. Due to the slanting angle of the arch surface 62, the end section of the pencil lead 40 is guided to the through hole 63 (referring to FIG. 9). At this point of time, when the pencil lead cylinder 4 is inserted, the sealing cap 42 is lowered to contact the other end of the pencil lead 40. The guiding arch surface 421 guides the end portion of the pencil lead 40 to the center region (as shown in FIG. 10) so that the pencil lead 40 is in a vertical position. Thus, when the top end is depressed, the pencil lead end 40 urged at the through hole 63 of the guiding tube 6 depresses the guiding tube 6, and the resilient element 50 is compressed until the guiding tube 6 cannot be lowered. Due to the continuous depression force on the pencil lead 40, it will pass through the guiding shaft 64 of the guiding tube 6 and to the through hole at the center of the combination rod 51 of the clipping device 5, and is lowered to the pencil head 3. The length of the pencil lead 40 can be set such that when the pencil lead cylinder 4 is depressed at the end portion, the pencil lead 40 is protruded from the pencil tip 30 sufficient for writing. If the pencil lead 40 is not pushed out from the pencil tip 30 or if the lead 40 is ended, the depression while writing will slowly withdraw the pencil lead. Thus, when the pencil lead 40 is inserted, no depression is needed the pencil lead 40 will continuously push out after the pencil lead 40 is used.

Figure 11:
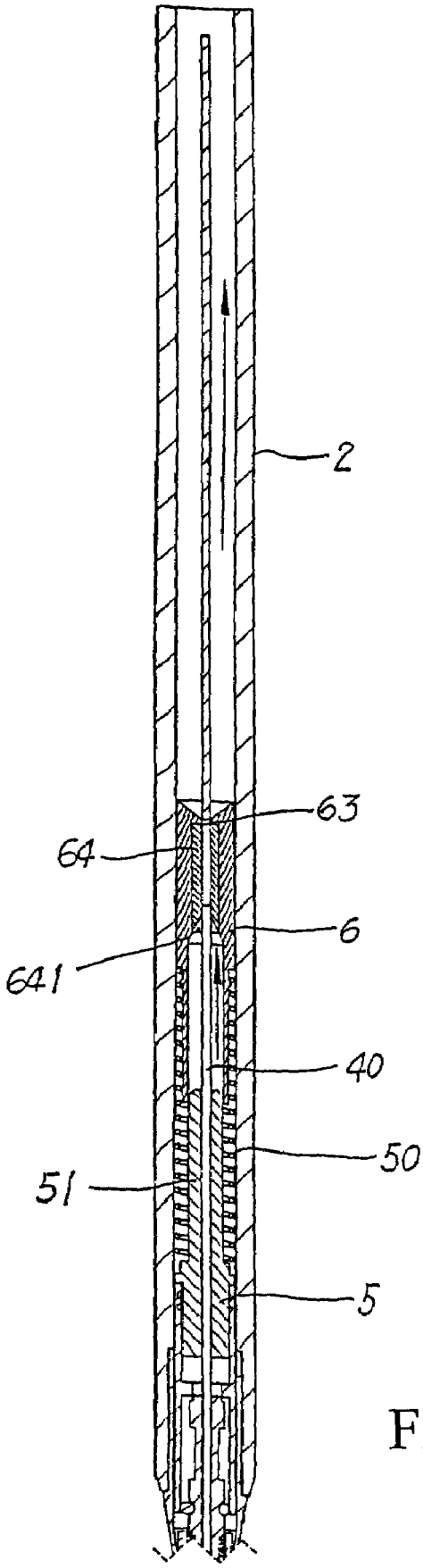
FIG. 11 is a schematic view showing the withdrawal of the pencil lead cylinder of the present invention.

When the pencil lead 40 is to be used completely, and a new pencil lead 40 is inserted, as shown in FIG. 11, the pencil lead cylinder 4 is withdrawn from the end head 41, the depression force on the guiding tube 6 is disappeared. The restoration of the resilient element 50 causes the guiding tube 6 to move upward to keep a distance from the original pencil lead 40. The space allows a new pencil lead 40 to be inserted. When the guiding tube 6 is depressed, due to the distance between the pencil lead and the combination rod 51, the original pencil lead 40 will not align with the through hole 63. In accordance with the present invention, the guiding rod 64 is mounted within the guiding tube 6 and the guiding rod 64 is hollow, the top end aligns with the through hole 63, and the bottom end is formed into a guiding hole 641. When the guiding rod 64 is depressed till the end head of the pencil lead 40, the guiding hole 641 will lead the pencil lead to the hollow interior of the guiding rod 64, and passes along the guiding hole 63 of the guiding tube. The pencil lead 40 will not be broken or engaged. Repeating the depress movement will push out the pencil lead 40 of the pencil tip 30 for writing.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

I claim:

1. An automatic pencil comprising:

a pencil shaft having a hollow interior, an upper end and a lower end;

a clipping device mounted within said pencil shaft and having a top provided with a combination rod;

a pencil head connected to a lower end of said pencil shaft, said pencil head having an upper end connected to said clipping device;

a guiding tube mounted on said clipping device, said guiding tube having a bottom provided with a mounting rod, said guiding tube having an upper end provided with a guiding arch face which is extended to a through hole formed at a center of said guiding tube for passage of a pencil head;

a resilient member connected between said mounting rod of said guiding tube and said combination rod of said clipping device;

a guiding rod positioned within said guiding tube and formed with a guiding hole;

a pencil lead cylinder inserted into said hollow interior of said pencil shaft, said pencil lead cylinder being tubular in shape, said pencil head cylinder having a lower end formed with a guiding arch surface; and a sealing cap engageable with a lower end of said pencil lead cylinder.

2. The automatic pencil as claimed in claim 1, wherein said pencil lead cylinder has an end head provided with an eraser.

* * * * *